US007492084B2

(12) United States Patent
Park et al.

(10) Patent No.: US 7,492,084 B2
(45) Date of Patent: Feb. 17, 2009

(54) FLAT-TYPE FLUORESCENT LAMP INCLUDING A DISCHARGE SPACE AND AN ELECTRODE PART INCLUDING ELECTRON-TRANSPORTING AND ELECTRON-EMITTING ELECTRODES METHOD OF MANUFACTURING THE SAME AND DISPLAY APPARATUS HAVING THE SAME

(75) Inventors: Hae-Il Park, Seoul (KR); Sang-Yu Lee, Yongin-si (KR); Jin-Seob Byun, Seoul (KR)

(73) Assignee: Samsung Electronics Co., Ltd. (KR)

( * ) Notice: Subject to any disclaimer, the term of this patent is extended or adjusted under 35 U.S.C. 154(b) by 583 days.

(21) Appl. No.: 11/229,813

(22) Filed: Sep. 19, 2005

(65) Prior Publication Data

US 2006/0108922 A1 May 25, 2006

(30) Foreign Application Priority Data

Sep. 22, 2004 (KR) ..... 10-2004-0076060

(51) Int. Cl.
*H01J 1/62* (2006.01)

(52) U.S. Cl. ..... 313/492; 313/581; 349/71

(58) Field of Classification Search ..... 313/491, 313/492, 581; 349/71
See application file for complete search history.

(56) References Cited

U.S. PATENT DOCUMENTS

| | | | | |
|---|---|---|---|---|
| 5,479,069 | A * | 12/1995 | Winsor | 313/493 |
| 6,707,250 | B2 * | 3/2004 | Okano et al. | 313/582 |
| 6,858,979 | B2 * | 2/2005 | Park et al. | 313/495 |
| 2005/0099137 | A1 * | 5/2005 | Park et al. | 315/160 |
| 2005/0110378 | A1 * | 5/2005 | Jang et al. | 313/1 |
| 2006/0018128 | A1 * | 1/2006 | Park et al. | 362/600 |
| 2006/0076873 | A1 * | 4/2006 | Suk | 313/477 HC |
| 2006/0125375 | A1 * | 6/2006 | Hwang et al. | 313/496 |
| 2007/0058106 | A1 * | 3/2007 | Kim et al. | 349/71 |

* cited by examiner

*Primary Examiner*—Peter Macchiarolo
(74) *Attorney, Agent, or Firm*—F. Chau & Associates, LLC

(57) ABSTRACT

A flat-type fluorescent lamp includes a body having a plurality of discharge spaces, an electrode part disposed inside the body and crossing each of the discharge spaces and a light generating part generating a visible light by using the emitted electron. The electrode part includes an electron-transporting electrode transporting electrons from an exterior and an electron-emitting electrode on the transporting electrode to activate emission of the electrons to the discharge spaces. The flat-type fluorescent lamp has high brightness and low power consumption.

30 Claims, 13 Drawing Sheets

FLAT-TYPE FLUORESCENT LAMP INCLUDING A DISCHARGE SPACE AND AN ELECTRODE PART INCLUDING ELECTRON-TRANSPORTING AND ELECTRON-EMITTING ELECTRODES METHOD OF MANUFACTURING THE SAME AND DISPLAY APPARATUS HAVING THE SAME

CROSS-REFERENCE TO RELATED APPLICATION

This application claims priority from Korean Patent Application No. 2004-76060 filed on Sep. 22, 2004, the contents of which are incorporated herein by reference in their entirety.

BACKGROUND OF THE INVENTION

1. Technical Field

The present disclosure relates to a flat-type fluorescent lamp, a method of manufacturing the flat-type fluorescent lamp and a display apparatus having the flat-type fluorescent lamp. More particularly, the present disclosure relates to a flat-type fluorescent lamp capable of increasing brightness and reducing power consumption, a method of manufacturing the flat-type fluorescent lamp and a display apparatus having the flat-type fluorescent lamp.

2. Discussion of the Related Art

A display apparatus such as a liquid crystal display apparatus includes a backlight assembly that generates a light used to display an image.

In order to generate the light, the backlight assembly for the liquid crystal display apparatus includes a light source, for example, a light emitting diode (LED), a cold cathode fluorescent lamp (CCFL), or a flat-type fluorescent lamp (FFL).

The flat-type fluorescent lamp has been applied to various electrical instruments since the flat-type fluorescent lamp has uniform brightness compared to the LED and the CCFL. However, the flat-type fluorescent lamp has low brightness and high power consumption.

SUMMARY OF THE INVENTION

A flat-type fluorescent lamp capable of enhancing brightness and reducing power consumption, a method suitable for manufacturing the above flat-type fluorescent lamp, and a display apparatus having the above flat-type fluorescent lamp are provided.

In accordance with an embodiment of the present invention, a flat-type fluorescent lamp includes a body, an electrode part, and a light generating part. The body has a plurality of discharge spaces. The electrode part is disposed in the body to cross the discharge spaces. The electrode part includes an electron-transporting electrode to transport electrons in response to a power voltage from an exterior, and an electron-emitting electrode on the electron-transporting electrode to activate emission of the electrons to the discharge spaces. The light generating part generates a visible light based on the emitted electron.

In accordance with another embodiment of the present invention, a flat-type fluorescent lamp includes a body including a first substrate and a second substrate, an electrode part disposed on the first substrate in the body to cross each of the discharge parts, and a fluorescent layer. The second substrate includes a discharge part to form a discharge space and an isolation part to isolate each of the discharge spaces. The electrode part includes an electron-transporting electrode and an electrode-emitting electrode. The electrode-transporting electrode transports electrons in response to a power voltage from an exterior, and the electron-emitting electrode is disposed on the transporting electrode and activates emission of the electrons to the discharge parts. The fluorescent layer generates a visible light.

In accordance with another embodiment of the present invention, a method of manufacturing a flat-type fluorescent lamp includes forming an electron-transporting electrode on a first substrate to transport an electron from an exterior, forming an electron-emitting electrode to activate emission of the electron onto the electron-transporting electrode, and sealing the first substrate and a second substrate to form a discharge space between the first and second substrates.

In accordance with another embodiment of the present invention, a display apparatus includes a flat-type fluorescent lamp and a display panel. The flat-type fluorescent lamp includes a body, an electrode part and a light generating part. The body includes a plurality of discharge spaces. The electrode part is disposed inside the body, and the electrode part includes a first electrode to which a power voltage is applied and a second electrode formed on the first electrode to activate emission of electrons to the discharge spaces. The light generating part generates a visible light using the emitted electrons. The display panel converts the visible light into an image.

In accordance with the embodiments of the present invention, the flat-type fluorescent lamp is capable of enhancing brightness and reducing power consumption.

BRIEF DESCRIPTION OF THE DRAWINGS

Preferred embodiments of the present invention can be understood in more detail from the following descriptions taken in conjunction with the accompanying drawings in which.

DETAILED DESCRIPTION OF THE PREFERRED EMBODIMENTS

Preferred embodiments of the present invention will now be described more fully hereinafter below in more detail with reference to the accompanying drawings, in which preferred embodiments of the invention are shown.

Figure 1:
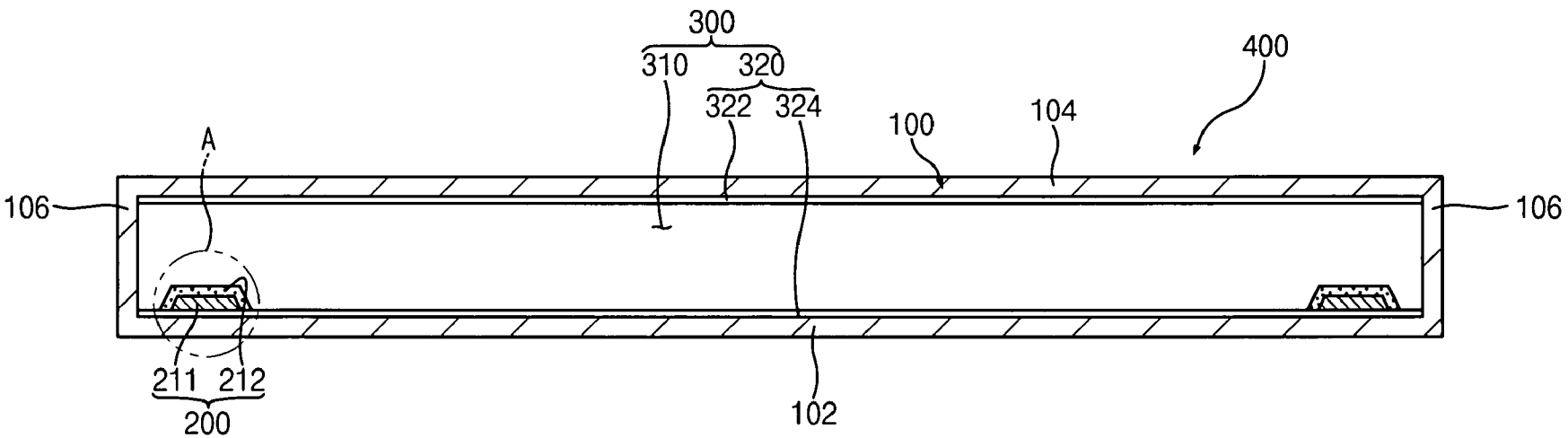
FIG. 1 is a cross-sectional view illustrating a flat-type fluorescent lamp in accordance with an embodiment of the present invention.

FIG. 1 is a cross-sectional view illustrating a flat-type fluorescent lamp in accordance with an embodiment of the present invention.

Referring to FIG. 1, a flat-type fluorescent lamp 400 includes a body 100, an electrode part 200 and a light generating part 300.

The body 100 includes a first face 102, a second face 104 and a sidewall 106.

The first face 102 faces the second face 104, and the sidewall 106 connects the first and second faces 102 and 104 to form an inner space between the first and second faces 102 and 104.

In the present embodiment, the body 100 has a substantially rectangular parallelepiped shape. The body 100 includes a transparent material such as glass that transmits visible light.

The body 100 has a plurality of discharge spaces formed therein. The discharge spaces are arranged in parallel with each other.

The electrode part 200 is disposed on the first face 102. Alternatively, the electrode part 200 may be disposed on the second face 104. Also, the electrode part 200 may be disposed on both the first and second faces 102 and 104.

In the present embodiment, two electrode parts 200 are disposed on both sides adjacent to the sidewall 106, respectively.

The electrode part 200 includes an electron-transporting electrode 211 and an electron-emitting electrode 212.

The electron-transporting electrode 211 has a substantially bar-shape, and is disposed on the first face 102 to cross the discharge spaces.

A portion of the electron-transporting electrode 211, for example, an end of the electron-transporting electrode 211 is disposed outside the body 100. A power supply such as an inverter is electrically connected to the electron-transporting electrode 211 through a power line (not shown).

The electron-emitting electrode 212 activates and accelerates the electrons from the electron-transporting electrode 211. The electron-emitting electrode 212 is disposed on the electron-transporting electrode 211 to cover the electron-transporting electrode 211.

Alternatively, the electron-emitting electrode 212 may be partially disposed on the electron-transporting electrode 211.

Figure 2:
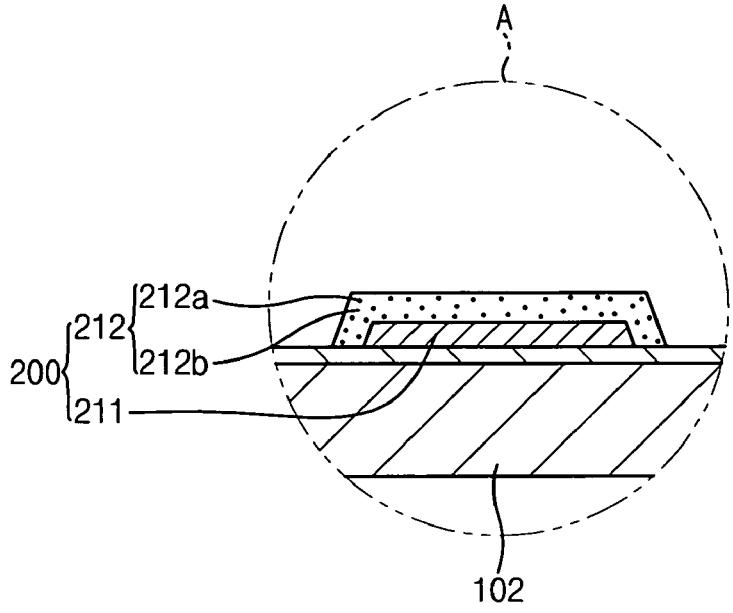
FIG. 2 is an enlarged view illustrating a portion "A" in FIG. 1.
Figure 3:
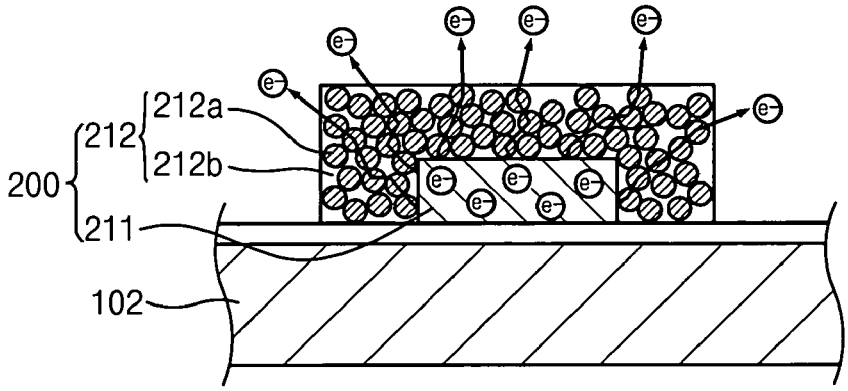
FIG. 3 is a cross-sectional view illustrating an emission path of an electron.

FIG. 2 is an enlarged view illustrating a portion "A" in FIG. 1. FIG. 3 is a cross-sectional view illustrating emission paths of electrons.

Referring to FIGS. 2 and 3, the electron-emitting electrode 212 includes a conductive bead 212*a* and an insulation bead 212*b*.

The conductive bead 212*a* includes a metal such as copper (Cu), molybdenum (Mo), nickel (Ni) and so on. The conductive bead 212*a* has a substantially circular shape or a substantially polygonal shape.

The insulation bead 212*b* is formed between the conductive bead 212*a* and an adjacent conductive bead, and the insulation bead 212*b* includes an oxide. Examples of the insulation bead may include titanium dioxide ($TiO_2$), titanium trioxide ($TiO_3$), silicon oxide ($SiO_2$), lead oxide ($PbO_3$.), etc.

When a power voltage is applied to the electron-transporting electrode 211, electrons in the electron-transporting electrode 211 are transported to the electron-emitting electrode 212. The electrons transported inside the electron-emitting electrode 212 are transported to the surface of the electron-emitting electrode 212. The transported electrons are emitted to the discharge space.

Referring to FIG. 1, the light generating part 300 includes a discharge gas 310 injected into the discharge space and a fluorescent layer 320.

In the present embodiment, examples of the discharge gas 310 may include mercury gas, argon gas, neon gas, krypton gas, xenon gas, etc. For example, the mercury gas collides with the electrons emitted from the electron-emitting electrode 212 to generate an invisible light such as an ultraviolet light. The fluorescent layer 320 is disposed on an inner surface of the body to convert the invisible light into visible light. The fluorescent layer 320 may be disposed between the electron-transporting electrode 211 and the body 100, or disposed on the electron-emitting electrode 212 to cover the electron-emitting electrode 212.

Figure 4:
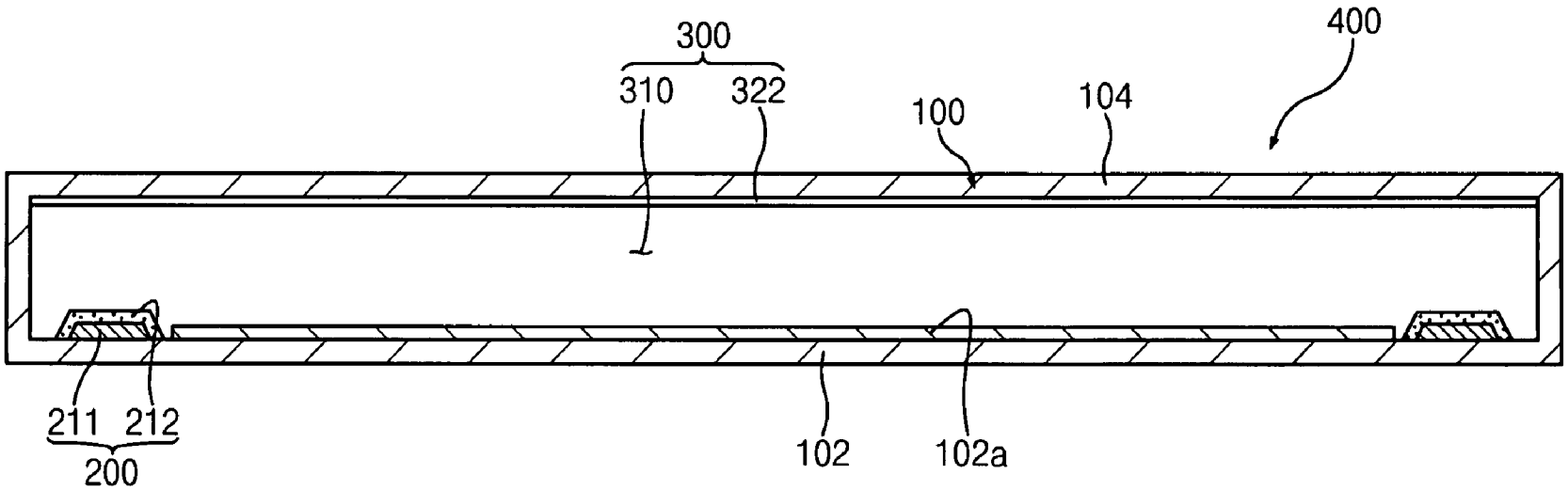
FIG. 4 is a cross-sectional view illustrating a flat-type fluorescent light reflective layer of the flat-type fluorescent lamp in FIG. 1.

FIG. 4 is a cross-sectional view illustrating a flat-type fluorescent light reflective layer of the flat-type fluorescent lamp in FIG. 1.

Referring to FIG. 4, a light reflective layer 102*a* is disposed on the first face 102. In the present embodiment, the light reflective layer 102*a* is disposed between the first face 102 and the fluorescent layer 322. The light reflective layer 102*a* includes a metal oxide. The light reflective layer 102*a* reflects light generated in the body 100 to the second face 104, to thereby improve a brightness of the light exiting from the second face 104.

Figure 5:
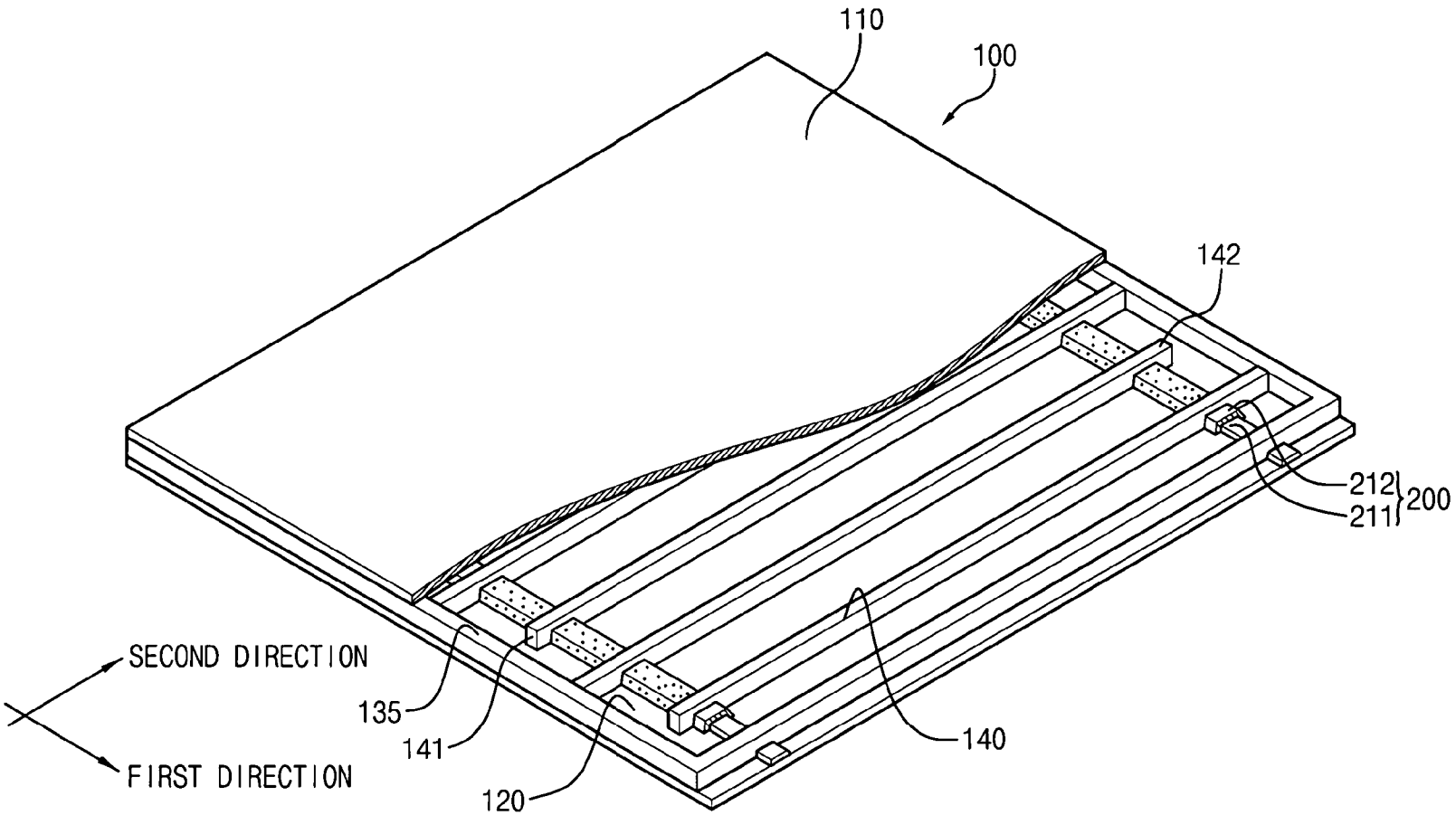
FIG. 5 is a partially cut out perspective view illustrating a flat-type fluorescent lamp in accordance with an embodiment of the present invention.

FIG. 5 is a partially cut out perspective view illustrating a flat-type fluorescent lamp in accordance with another embodiment of the present invention.

In the present embodiment, the flat-type fluorescent lamp has substantially the same function and structure as the flat-type fluorescent lamp in FIG. 1 except for the body. Therefore, only different parts to the flat-type fluorescent lamp will be described herein. In FIG. 5, the same reference numerals are used to refer to the same or like parts as those in FIG. 1 and any repetitive descriptions are omitted.

Referring to FIG. 5, a body 100 includes a first substrate 110, a second substrate 120, a sealant 135 and space-dividing members 140.

The first substrate 110 includes, for example, a glass. The first substrate 110 has a substantially rectangular parallelepiped-shaped plate.

The second substrate 120 corresponds to the first substrate 110, and includes glass like the first substrate 110. The second substrate 120 has substantially the same size and shape as those of the first substrate 110. A pair of electrode parts 200 is formed on the second substrate 120 and extended in a first direction. The electrode parts 200 are spaced apart from each other, and are adjacent to both ends of the second substrate 120, respectively. Each of the electrode parts 200 includes an electron-transporting electrode 211 and an electron-emitting electrode 212. The electron-emitting electrode 212 is disposed on the electron-transporting electrode 211, and includes a conductive bead and an insulation bead to activate and accelerate electrons.

The sealant 135 has a substantially frame shape. The sealant 135 is disposed between the first and second substrates 110 and 120 so as to seal a space between the first and second substrates 110 and 120.

The space-dividing members 140 are disposed on the first substrate 110 or the second substrate 120. The space-dividing members 140 are arranged in a first direction and extended in a second direction that is substantially perpendicular to the first direction. The space formed between the first and second substrates 110 and 120 is divided into at least two spaces by at least one space-dividing member 140, and thus at least two discharge spaces are formed between the first and second substrates 110 and 120.

When pressure in each of the discharge spaces is different from one another, an amount of a light generated in each of the discharge spaces is different from one another, so that brightness uniformity of the light generated in the fluorescent lamp decreases.

In the present embodiment, the pressures caused by the discharge gas injected into each of the discharge spaces may be controlled to have a substantially same pressure using the illustrated configuration of the space-dividing members 140.

In order to control the pressure of the discharge gas in each of the discharge spaces, the space-dividing members 140 have a first end 141 and a second end 142 alternately connected to the sealant 135. Referring to FIG. 5, the second end 142 of a first space-dividing member 140 and the first end 141 of the adjacent space-dividing member 140 are respectively connected to the sealant 135. Therefore, the discharge spaces formed between the first and second substrates 110 and 120 have a serpentine shape when viewed as a whole.

Figure 6:
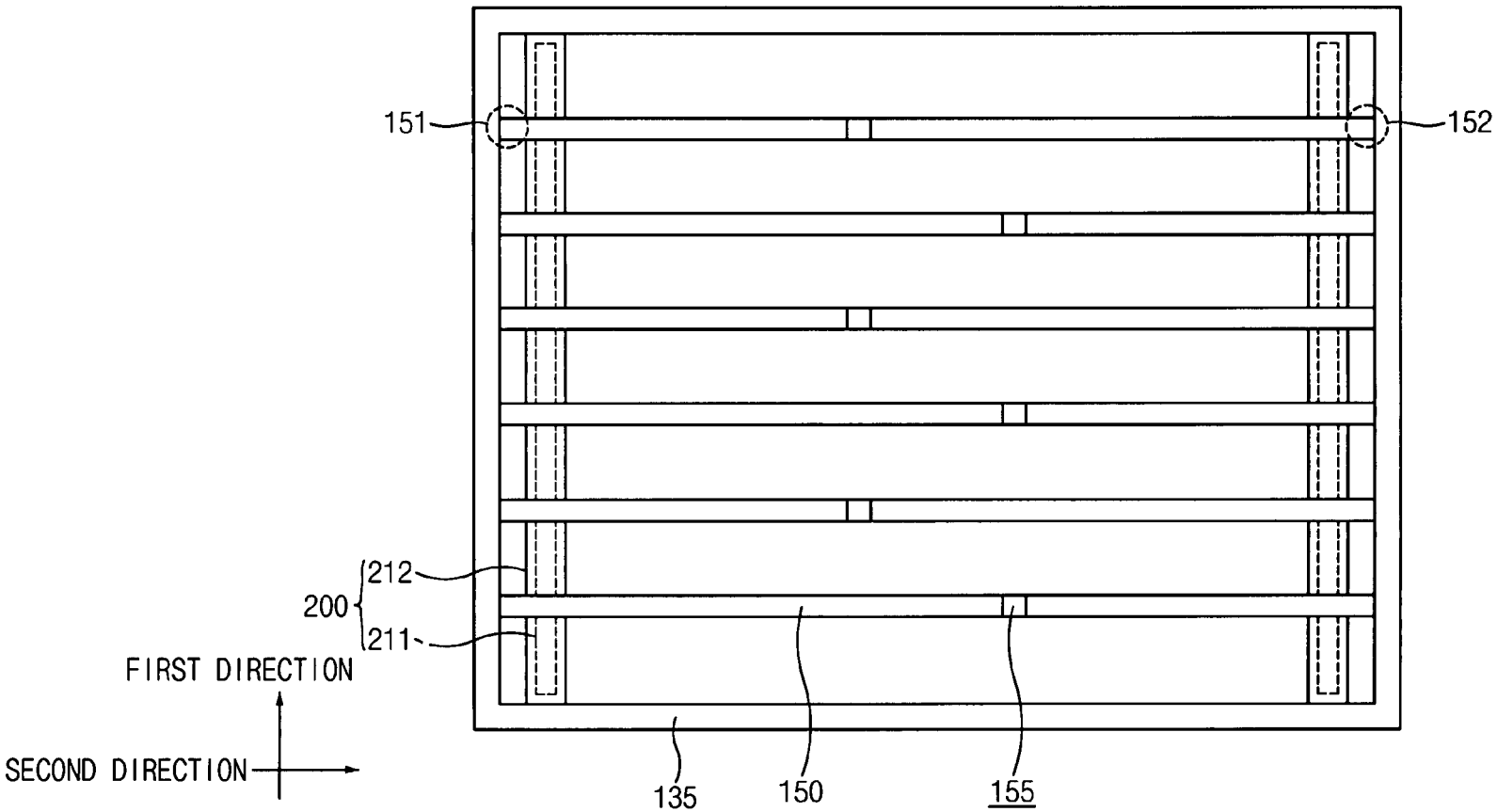
FIG. 6 is a plan view illustrating a flat-type fluorescent lamp in accordance with still an embodiment of the present invention.

FIG. 6 is a plan view illustrating a flat-type fluorescent lamp in accordance with another embodiment of the present invention.

In the present embodiment, a flat-type fluorescent lamp has substantially the same function and structure the flat-type fluorescent lamp in FIG. 5 except for the space-dividing members. Therefore, only different parts to the flat-type fluorescent lamp will be described herein. In FIG. 6, the same reference numerals are used to refer to the same or like parts as those in FIG. 5 and any repetitive descriptions are omitted.

Referring to FIG. 6, the space-dividing members 150 are arranged in a first direction and extended in a second direction substantially perpendicular to the first direction.

The space-dividing members 150 have a first end 151 and a second end 152, and the first and second ends 150 and 151 of the space-dividing members 150 are connected to the sealant 135.

Since the first and second ends 151 and 152 are connected to the sealant 135, the discharge spaces formed between the space-dividing members 150 are isolated from each other. The space-dividing members 150 have a penetrating hole 155, and the penetrating hole 155 spatially connects the discharge spaces to each other. Therefore, a discharge gas may be uniformly injected into each of the discharge spaces so as to allow the discharge spaces to have a substantially equal pressure. As shown in FIG. 6, a penetrating hole 155 formed through a space-dividing member 150 does not correspond to or line up with a penetrating hole 155 formed through an adjacent space-dividing member.

Figure 7:
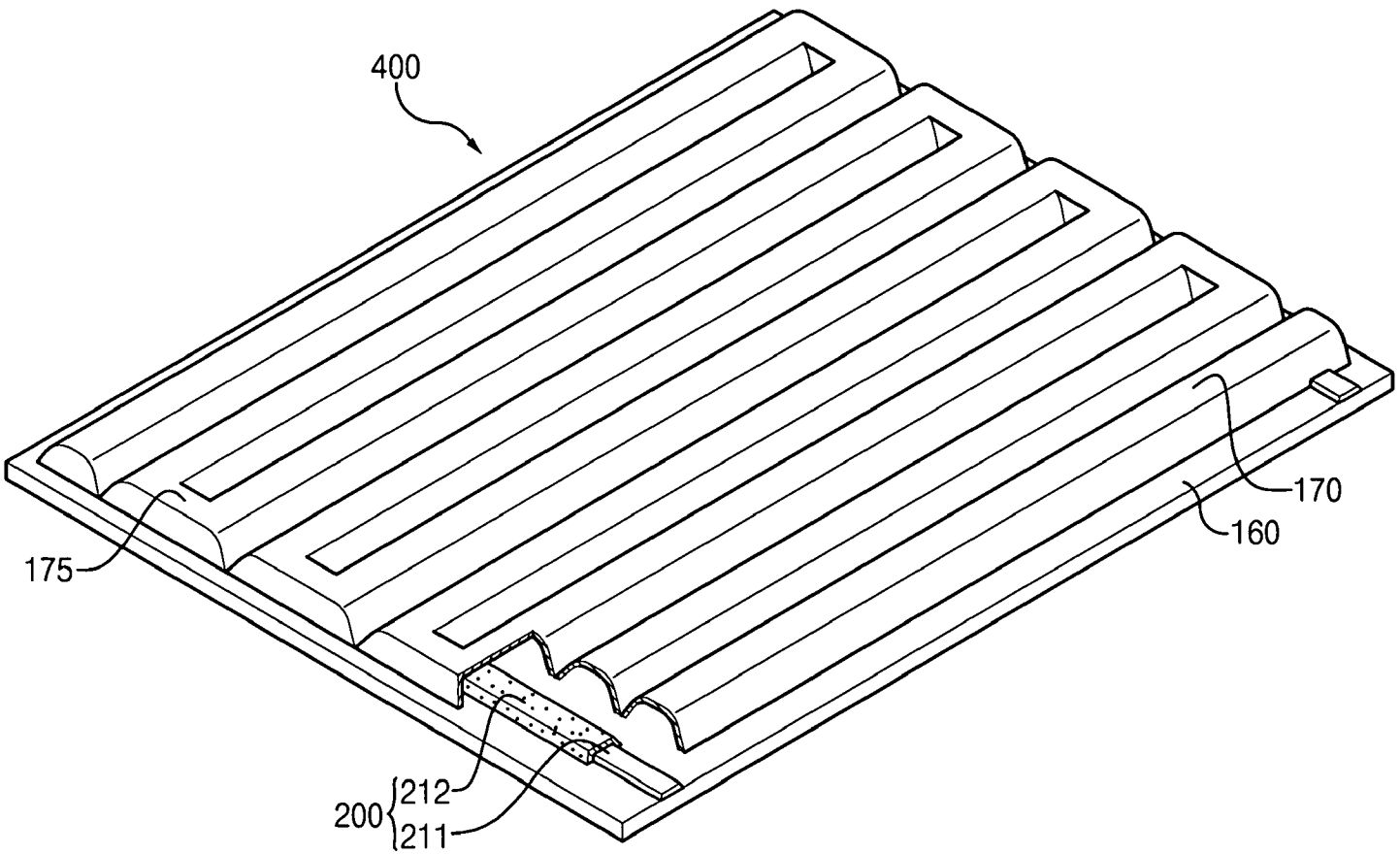
FIG. 7 is a partially cut out perspective view illustrating a flat-type fluorescent lamp in accordance with an embodiment of the present invention.

FIG. 7 is a partially cut out perspective view illustrating a flat-type fluorescent lamp in accordance with another embodiment of the present invention.

In the present embodiment, a flat-type fluorescent lamp has substantially the same function and structure as those of the flat-type fluorescent lamp in FIG. 5 except for the body. Therefore, only different parts to the flat-type fluorescent lamp will be described herein. In FIG. 7, the same reference numerals are used to refer to the same or like parts as those in FIG. 5 and any further repetitive descriptions will be omitted.

Referring to FIG. 7, the body 100 includes a first substrate 160 and a second substrate 170.

Referring to FIG. 7, the first substrate 160 has a rectangular plate-like shape. The first substrate 160 includes a glass.

The second substrate 170 has a first part that is spaced apart from the first substrate 160 and a second part that makes contact with the first substrate 160. The first and second parts are alternately disposed on the first substrate. The first part forms a discharge space between the first and second substrates 160 and 170. The second part isolates each of discharge spaces.

A connecting path 175 formed in the second substrate 170 connects the discharge spaces to each other.

Figure 8:
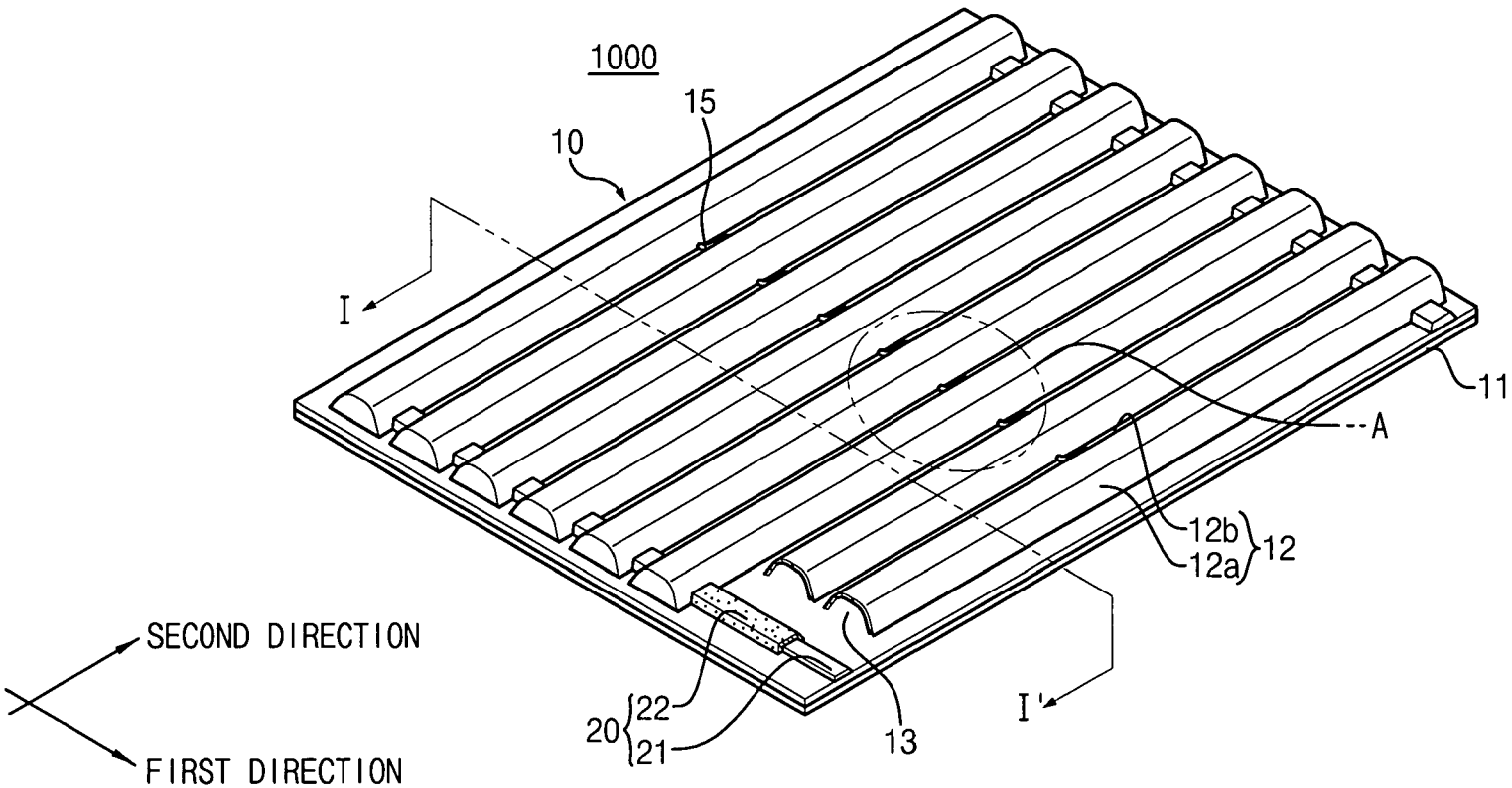
FIG. 8 is partially cut out perspective view illustrating a flat-type fluorescent lamp in accordance with an embodiment of the present invention.
Figure 9:
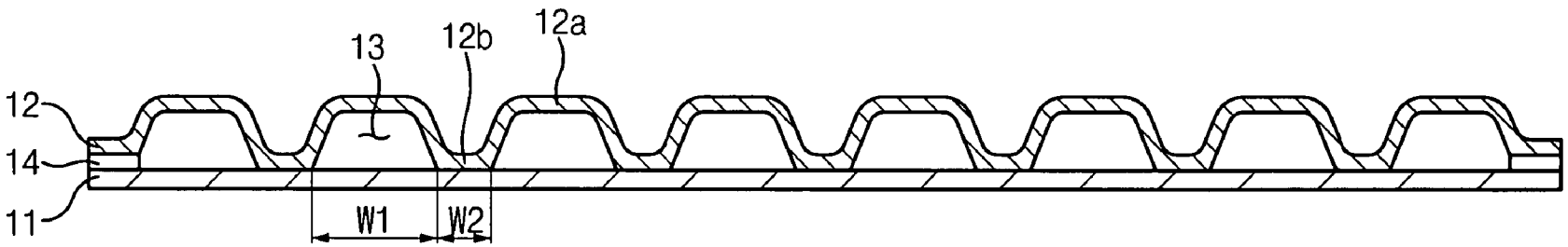
FIG. 9 is a cross-sectional view taken along a line I-I' in FIG. 8.

FIG. 8 is partially cut out perspective view illustrating a flat-type fluorescent lamp in accordance with another embodiment of the present invention. FIG. 9 is a cross-sectional view taken along a line I-I' in FIG. 8.

Referring to FIGS. 8 and 9, a flat-type fluorescent lamp 1000 includes a body 10 emitting a surface light, and an electrode part 20 including a first electrode 21 and a second electrode 22.

A plurality of discharge spaces 13 is formed in the body. The discharge spaces 13 are spaced apart from each other by a predetermined distance.

The body 10 includes a first substrate 11 and a second substrate 12 facing the first substrate 11.

The first substrate 11 has a substantially rectangular plate-like shape. The first substrate 11 includes a glass substrate that transmits a visible light and absorbs an invisible light. The first substrate 11 further includes a fluorescent layer converting the invisible light into the visible light, and a light reflective layer.

The second substrate 12 is engaged with the first substrate 11 to form the discharge spaces 13. The second substrate 12 includes a glass substrate that transmits a visible light and absorbs an invisible light.

The second substrate 12 includes a discharge part **12*a* and an isolation part 12*b*. The discharge part 12*a* is formed on the first substrate 11, and the discharge part 12*a* generates an invisible light by collision between a discharge gas and an emitted electron. The isolation part 12*b* isolates the discharge parts 12*a* from each other to prevent the discharge parts 12*a*** from being electrically affected by each other. The fluorescent layer is formed inside the discharge part to convert the invisible light into a visible light.

The discharge part **12*a* is extended in a second direction, and a plurality of discharge parts is arranged in a first direction. The discharge part 12*a* has a first width 'W1**' ranging from about 10 mm to about 12 mm.

The isolation part **12*b* has a second width 'W2' smaller than the first width 'W1'. The second width 'W2' ranges from about 2 mm-about 5 mm. Preferably, the isolation part 12*b* has a second width 'W2**' that ranges from about 2.4 mm to about 2.8 mm.

The discharge part **12*a* and the isolation part 12*b*** are formed by press-forming a heated substrate in a mold after heating a substrate having a plate-like shape to lower a strength of the substrate.

A cross section of the discharge part **12*a***, may have a substantially half circular shape, a quadrangular shape, etc.

The second substrate 12 is adhered to the first substrate 11 using an adhesive member 14, for example, a frit. The frit is formed by mixing a glass with a metal. The adhesive member 14 is disposed between frame lines of the first and second substrates 11 and 12. Alternatively, the adhesive member 14 may be disposed locally at the frame lines of the first and second substrates 11 and 12.

A discharge gas is injected into the discharge space 13. Examples of the discharge gas may include mercury gas, neon gas, argon gas, xenon gas, krypton gas, etc.

Figure 10:
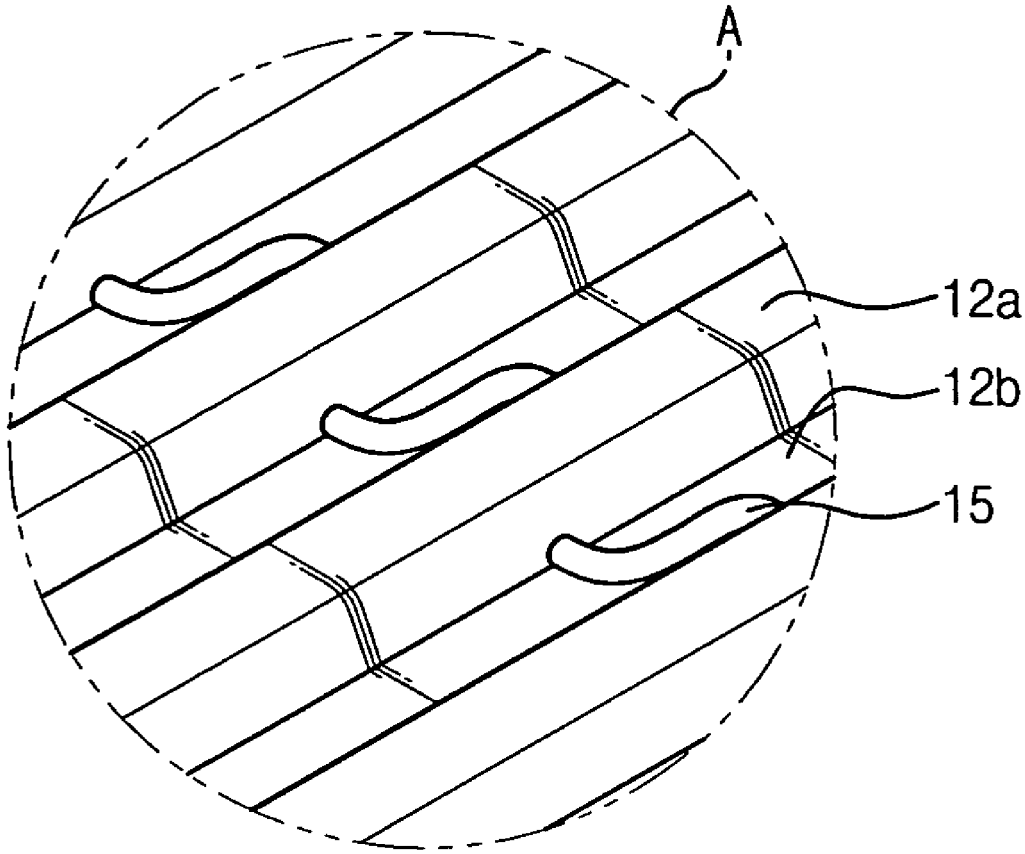
FIG. 10 is an enlarged view illustrating a portion "A" in FIG. 8.

FIG. 10 is an enlarged view illustrating a portion "A" in FIG. 8.

Referring to FIG. 10, the discharge parts 12*a* are connected to each other by a connecting member 15 formed on the isolation part 12*b* so as to provide substantially equal pressure in each of the discharge spaces 13.

The connecting member 15 is formed on the isolation part 12*b*. The connecting member 15 has an S-shape, wherein a central slanted portion of the S is extended in the second direction. The connecting member 15 prevents plasma generated in one of the discharge spaces 13 from moving to another discharge space 13 by extending a length of the connecting member 15.

The connecting member 15 may have a straight shape instead of a substantially S-shape. In addition, the connecting member 15 may have variable shapes other than the S or straight shapes.

Referring now to FIG. 8, the electrode part 20 is formed between the first and second substrates 11 and 12 to activate electrons to result in a collision between a discharge gas and emitted electrons in a discharge space.

The electrode part 20 is disposed on the first substrate 11. The electrode part 20 is disposed to cross the discharge parts 12*a*. In the present embodiment, a pair of the electrode parts is disposed on the first substrate 11 in parallel with each other and extended in the first direction.

The electrode part 20 includes an electron-transporting electrode 20*a* and an electron-emitting electrode 20*b*.

The electron-transporting electrode 20*a* has a bar-shape, and an end portion of the electron-transporting electrode 20*a* is disposed outside the second substrate 12. A power supply such as an inverter is electrically connected to the electron-transporting electrode 20*a* through an electric power line (not shown).

The electron-emitting electrode 20*b* activates and accelerates the electrons from the electron-transporting electrode 20*a*. The electron-emitting electrode 20*b* is disposed on the electron-transporting electrode 20*a* to cover the electron-transporting electrode 20*a*.

Figure 11:
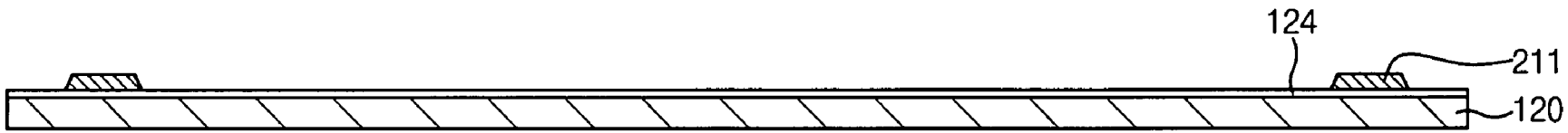
FIG. 11 is a cross-sectional view illustrating forming an electron-transporting electrode on a lower substrate.

FIG. 11 is a cross-sectional view illustrating forming an electron-transporting electrode on a lower substrate.

Referring to FIG. 11, a fluorescent layer 124 is entirely formed on a lower substrate 120. The fluorescent layer 124 is formed by spraying a fluorescent material in a liquid state onto the lower substrate 120.

The electron-transporting electrode 211 is formed by spraying a conductive thin film layer material including a metal onto the entire fluorescent layer 124. Alternatively, the electron electrode 211 may be formed by depositing a conductive material through a chemical vapor deposition process or a sputtering process, and patterning the deposited surface by performing a photolithography process.

Figure 12:
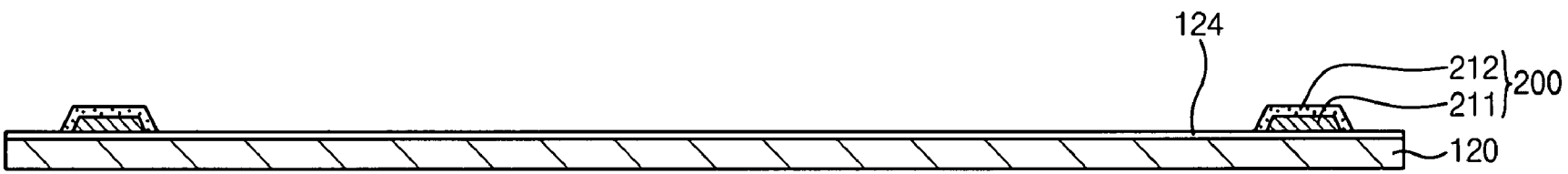
FIG. 12 is a cross-sectional view illustrating forming an electron-emitting electrode on an electron-transporting electrode.

FIG. 12 is a cross-sectional view illustrating forming an electron-emitting electrode on an electron-transporting electrode.

An electron-emitting electrode 212 is formed on the electron-transporting electrode 211. The electron-emitting electrode 212 includes a mixture of a conductive bead and an insulation bead. The conductive bead includes metals such as copper (Cu), molybdenum (Mo), nickel (Ni), etc. or a mixture thereof. The insulation bead 212*b* includes an oxide. Examples of the oxide include $TiO_2$, $TiO_3$, $SiO_2$, $PbO_3$, etc. or a mixture thereof.

Figure 13:
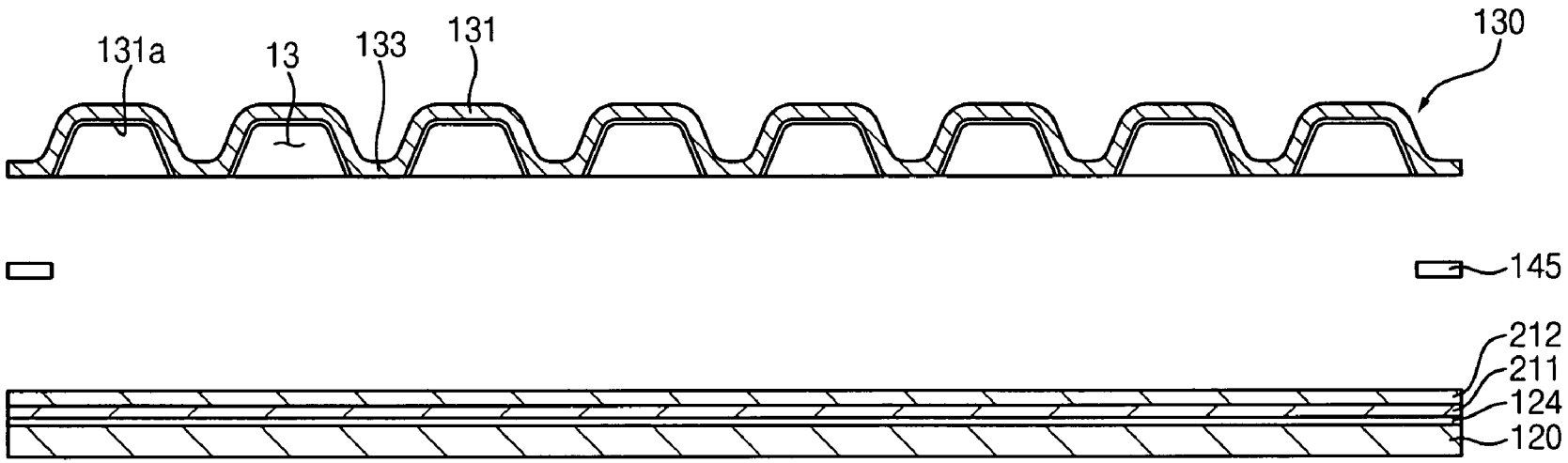
FIG. 13 is a cross-sectional view illustrating assembling a lower substrate and an upper substrate.

FIG. 13 is a cross-sectional view illustrating assembling a lower substrate and an upper substrate.

Referring to FIG. 13, an upper substrate 130 is disposed on a lower substrate 120.

The upper substrate 130 includes a discharge part 131 and an isolation part 133. The discharge part 131 is formed on the lower substrate 120, and the discharge part 131 generates an invisible light by collision between a discharge gas and an emitted electron. The isolation part 133 isolates the discharge parts 131 from each other to prevent the discharge parts 131 from being electrically affected by each other. A fluorescent layer 131*a* is formed inside the discharge part 131 to convert the invisible light into a visible light.

The upper substrate 130 is adhered to the lower substrate 120 through an adhesive member 145, for example, a frit. The frit is a mixture of a glass and a metal. The adhesive member 145 is disposed between frame lines of the lower and upper substrates 120 and 130. Alternatively, the adhesive member 145 is disposed to surround the frame lines of the lower and upper substrates 120 and 130.

A discharge gas is injected to the discharge space 13. Examples of the discharge gas include mercury gas, neon gas, argon gas, xenon gas, krypton gas, etc. The discharge gas is supplied to the discharge space 13 through a connecting member formed between the discharge parts 131.

Figure 14:
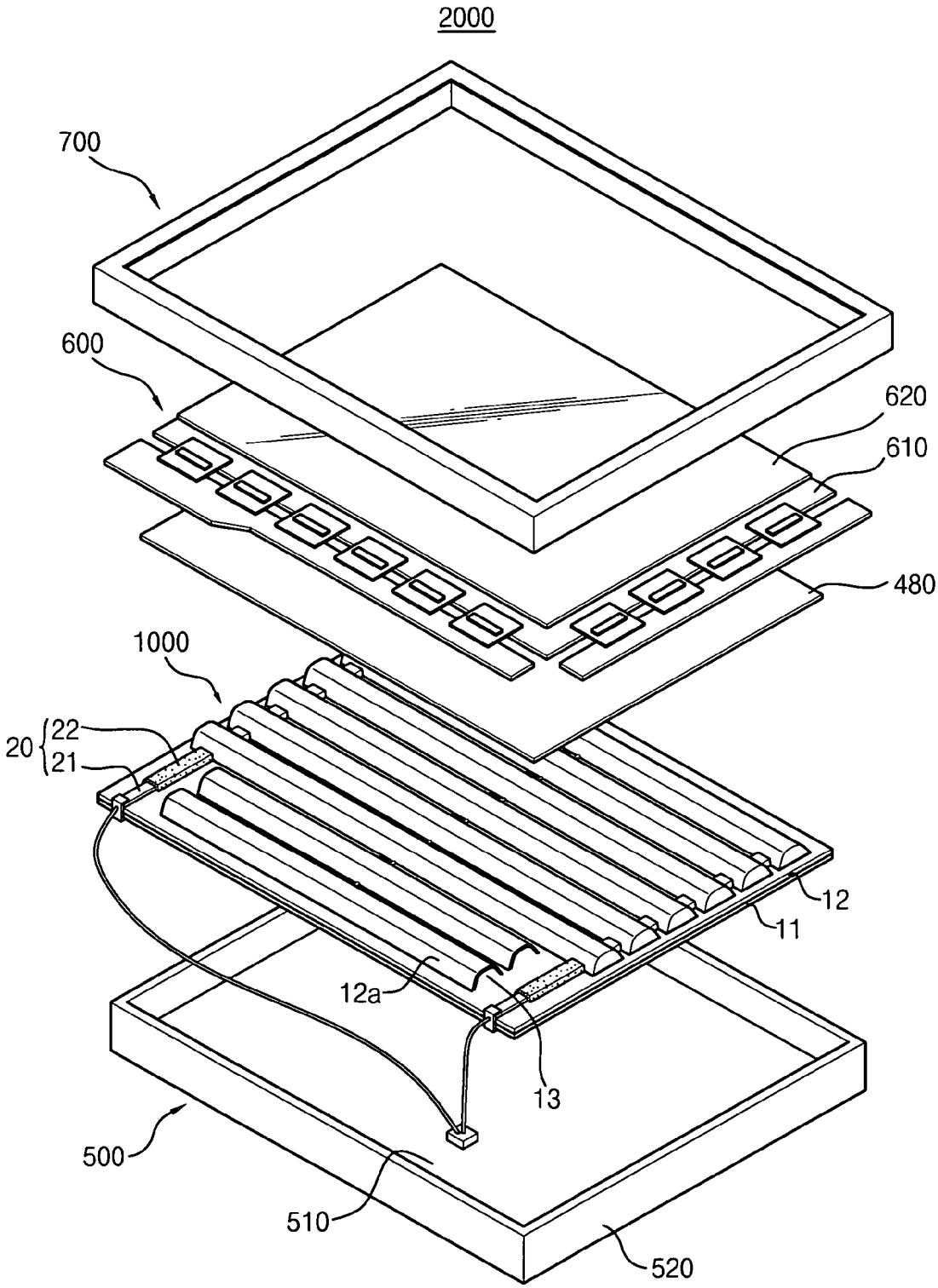
FIG. 14 is an exploded perspective view illustrating a display apparatus in accordance with an embodiment of the present invention.

FIG. 14 is an exploded perspective view illustrating a display apparatus in accordance with an embodiment of the present invention.

A flat-type fluorescent lamp in the present embodiment is substantially identical to the flat-type fluorescent lamp in FIG. 8. Therefore, further description about the flat-type fluorescent lamp is omitted. In FIG. 14, the same reference numerals are used to refer to the same or like parts as those in FIG. 8.

Referring to FIG. 14, a display apparatus 2000 includes a chassis 700, a display panel 600, a flat-type fluorescent lamp 1000 and a container 500.

The container 500 includes a sidewall 520 and a bottom face 510 to form a receiving space. The container 500 receives the display panel 600 and the flat-type fluorescent lamp 1000, and the container 500 is engaged with the chassis 700. The container further comprises an insulation member (not shown) insulating an electrode part 20 from the container 500.

The flat-type fluorescent lamp 1000 is disposed on the bottom face 510, and the display panel 600 is disposed on the fluorescent lamp 1000.

The display panel 600 includes a first substrate 610 including a thin film transistor and pixel electrodes, a second substrate 620 including a common electrode and a color filter, and a liquid crystal layer disposed between the first and second substrates 610 and 620.

The chassis 700 prevents the display panel 600 and the flat-type fluorescent lamp 1000 from becoming dislodged from the container 500, and also prevents the display panel 600 from being damaged due to an external impact.

The display apparatus includes an optical member 480 disposed between the flat-type fluorescent lamp 1000 and the display panel 600. In addition, the container 500 may further comprise a mold frame to support the optical member 480.

According to the above, the flat-type fluorescent lamp may maximize an efficiency of electron emission, thereby increasing brightness of the lamp and improving a uniformity of brightness.

Further, the flat-type fluorescent lamp may reduce power consumption of the display apparatus.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A flat-type fluorescent lamp comprising:

a body having a plurality of discharge spaces, wherein each discharge space is sealed at both longitudinal ends thereof and includes a hole inward from the ends spatially connecting the discharge space to an adjacent discharge space;

an electrode part disposed in the body and crossing the discharge spaces, the electrode part comprising:

an electron-transporting electrode to transport electrons in response to a voltage; and an electron-emitting electrode disposed on the electron-transporting electrode to activate emission of the electrons to the discharge spaces; and a light generating part to generate a visible light.

2. The flat-type fluorescent lamp of claim 1, wherein the electron-transporting electrode has a substantially bar-shape.

3. The flat-type fluorescent lamp of claim 1, wherein the electron-emitting electrode comprises a conductive bead and an insulation bead.

4. The flat-type fluorescent lamp of claim 3, wherein the insulation bead comprises an oxide.

5. The flat-type fluorescent lamp of claim 4, wherein the oxide comprises titanium dioxide ($TiO_2$), titanium trioxide ($TiO_3$), silicon oxide ($SiO_2$), lead oxide ($PbO_3$) or a combination thereof.

6. The flat-type fluorescent lamp of claim 3, wherein the conductive bead includes a metal.

7. The flat-type fluorescent lamp of claim 6, wherein the metal comprises copper (Cu), molybdenum (Mo), nickel (Ni) or a combination thereof.

8. The flat-type fluorescent lamp of claim 1, wherein the light generating part comprises:

a discharge gas injected into the body, wherein the discharge gas collides with the emitted electrons to generate an invisible light; and a fluorescent layer formed on an inner surface of the body to convert the invisible light into the visible light.

9. The flat-type fluorescent lamp of claim 8, wherein the electrode part is disposed between the fluorescent layer and the inner surface of the body.

10. The flat-type fluorescent lamp of claim 8, wherein the electrode part is disposed in the discharge space and on the fluorescent layer.

11. The flat-type fluorescent lamp of claim 1, further comprising a light reflective layer formed on a first face of the body, the light reflective layer reflecting a light toward a second face of the body corresponding to the first face.

12. The flat-type fluorescent lamp of claim 1, wherein the body comprises:

a first substrate;

a second substrate facing the first substrate;

a sealant disposed between the first and second substrates to form a discharge space between the first and second substrates; and a space-dividing member disposed between the first and second substrates to divide the discharge space into the plurality of discharge spaces.

13. The flat-type fluorescent lamp of claim 12, wherein the space-dividing member has a substantially bar-shape, and comprises first and second ends corresponding to the sealant.

14. The flat-type fluorescent lamp of claim 13, wherein the first end of a first space-dividing member and the second end of a second adjacent space-dividing member are respectively connected to the sealant.

15. The flat-type fluorescent lamp of claim 13, wherein the first and second ends of the space-dividing member contact the sealant.

16. The flat-type fluorescent lamp of claim 1, wherein the body comprises:

a first substrate; and a second substrate facing the first substrate, the second substrate having a first part that is spaced apart from the first substrate and second part that makes contact with the first substrate to form the plurality of discharge spaces between the first and second substrates, the discharge spaces being arranged in parallel with each other.

17. A flat-type fluorescent lamp comprising:

a body comprising:

a first substrate;

a second substrate comprising a plurality of discharge parts to form a plurality of discharge spaces and a plurality of isolation parts to isolate each of the plurality of discharge spaces, wherein each discharge part is sealed at both longitudinal ends thereof and includes a hole inward from the ends spatially connecting the discharge part to an adjacent discharge part;

an electrode part disposed on the first substrate and crossing each of the discharge parts, the electrode part comprising:

an electron-transporting electrode to transport electrons in response to a voltage; and an electron-emitting electrode disposed on the electron-transporting electrode to activate emission of the electrons to the discharge parts; and a fluorescent layer generating a light.

18. The flat-type fluorescent lamp of claim 17, wherein each of the plurality of isolation parts comprises a connecting member running from the holes for spatially connecting the plurality of discharge parts to each other to provide a substantially equal pressure in each of the plurality of discharge parts.

19. The flat-type fluorescent lamp of claim 17, wherein the light comprises a visible light.

20. A method of manufacturing a flat-type fluorescent lamp, the method comprising:

forming a fluorescent layer on a first substrate;

forming an electron-transporting electrode on the fluorescent layer to transport an electron;

forming on the electron-transporting electrode, an electron-emitting electrode for activating emission of the electron; and sealing the first substrate and a second substrate to form a plurality of discharge spaces between the first and the second substrates, wherein each discharge space is sealed at both longitudinal ends thereof and includes a hole inward from the ends spatially connecting the discharge space to an adjacent discharge space.

21. The method of claim 20, wherein the electron-emitting electrode comprises a conductive bead and an insulation bead.

22. The method of claim 21, wherein the insulation bead comprises an oxide.

23. The method of claim 22, wherein the oxide comprises titanium dioxide ($TiO_2$), titanium trioxide ($TiO_3$), silicon oxide ($SiO_2$), lead oxide ($PbO_3$) or a combination thereof.

24. The method of claim 21, wherein the conductive bead includes a metal.

25. The method of claim 24, wherein the metal comprises copper (Cu), molybdenum (Mo), nickel (Ni) or a combination thereof.

26. The method of claim 20, wherein the fluorescent layer on the first substrate covers the electron-transporting electrode.

27. The method of claim 20, further comprising injecting a discharge gas into the discharge spaces.

28. A display apparatus comprising:

a flat-type fluorescent lamp comprising:

a body comprising a plurality of discharge spaces, wherein each discharge space is sealed at both longitudinal ends thereof and includes a hole inward from the ends spatially connecting the discharge space to an adjacent discharge space;

an electrode part disposed inside the body, the electrode part comprising a first electrode to which a voltage is applied, a second electrode formed on the first electrode to activate emission of electrons to the discharge spaces; and a light generating part to generate a light; and a display panel to convert the light into an image.

29. The display apparatus of claim 28, wherein the display panel and the flat-type fluorescent lamp are received in a container, and an optical member is disposed between the display panel and the flat-type fluorescent lamp to control an optical property of the visible light.

30. The display apparatus of claim 28, wherein the light comprises a visible light.

* * * * *